United States Patent [19]

Richey

[11] Patent Number: 4,905,599

[45] Date of Patent: Mar. 6, 1990

[54] NOTCH CYLINDER UNIT

[75] Inventor: Jarold L. Richey, Dayton, Ohio

[73] Assignee: AM International, Inc., Chicago, Ill.

[21] Appl. No.: 205,872

[22] Filed: Jun. 13, 1988

[51] Int. Cl.[4] ..... B41F 13/56

[52] U.S. Cl. ..... 101/226; 101/224; 83/102; 83/117; 83/151; 83/671; 83/917

[58] Field of Search ..... 101/224, 226; 83/78, 83/150, 151, 115, 117, 671, 346, 917, 102

[56] References Cited

U.S. PATENT DOCUMENTS

| | | | |
|---|---|---|---|
| 837,633 | 12/1906 | McAnulty | 101/224 |
| 2,098,165 | 11/1937 | Riggenbach | 101/226 |
| 2,469,526 | 5/1949 | Sloat | 101/226 |
| 2,638,983 | 5/1953 | Ward | 83/117 |
| 3,339,827 | 9/1967 | Steidinger | 229/69 |
| 4,512,256 | 4/1985 | Schriber et al. | 101/248 |
| 4,784,031 | 11/1988 | Dixon | 101/224 X |

FOREIGN PATENT DOCUMENTS

| | | | |
|---|---|---|---|
| 716204 | 1/1942 | Fed. Rep. of Germany | 83/117 |
| 14284 | 2/1977 | Japan | 83/117 |
| 508307 | 5/1976 | U.S.S.R. | 83/117 |
| 364570 | 1/1932 | United Kingdom | 101/226 |
| 1087327 | 10/1967 | United Kingdom | 101/226 |

*Primary Examiner*—Edgar S. Burr
*Assistant Examiner*—Ren Yan
*Attorney, Agent, or Firm*—Biebel, French & Nauman

[57] ABSTRACT

A notch cylinder unit for selectively activating a plurality of impaling pins such as might be used for separating and removing a strip from a paper web. The notch cylinder unit comprises a cylinder having a longitudinally extending hole and a hollowing driving shaft extending therethrough, at least two rows of removable blades extending radially outwardly from and longitudinally of the cylinder, and adapted to cut a strip in the web, and a plurality of slidably mounted impaling pins generally equally spaced between the rows of blades and adapted to puncture, hook and remove the strip. The notch unit cylinder unit further includes an activating means including an activating means for activating or deactivating the impaling pins.

3 Claims, 2 Drawing Sheets

NOTCH CYLINDER UNIT

BACKGROUND OF THE INVENTION

The present invention relates to a device for selectively activating a plurality of impaling pins such as might be used for separating and removing a strip from a paper web. Such a device is particularly useful in machines for forming sheets made up of several multi-sized paper webs such as might be done in the manufacture of mailers having sealed envelopes with one or more web inserts.

Mailers made from continuous formed envelopes having one or more web inserts are commonly used and eliminate the need to stuff and seal individual envelopes as well as the cost of purchasing and storing the individual components.

Several methods of manufacturing multilayer mailers are disclosed in U.S. Pat. No. 3,339,827 to Steidinger and in U.S. Pat. No. 4,512,256 to Schriber et al. A plurality of webs are preprinted in certain discrete areas and generally include material which will be the same from one mailer to another.

Each preprinted web is then cut transversely across its longitudinal extent at spaced locations between the preprinted areas to remove a strip extending from one margin substantially into, but not through, the other margin. The removed strip provides a slot in the web which is substantially equidistant between the preprinted areas and divides the web into individual and properly sized and positioned insert web portions, each containing the preprinted material.

The insert web portions from each preprinted web are then collated into insert web layers. Each web layer is positioned between a front web and a back web. Both front and back webs are wider than the insert webs and their outer perimeters are positioned and glued together to form individual envelopes containing the cut insert web layers.

The cutting, separating, and removing of the strip is normally performed by passing a web having the preprinted areas, between a pair of driven cylinders or rolls. One of the cylinders is adapted for mounting at least two rows of removable blades extending radially outwardly from and longitudinally of the cylinder. The rows are positioned such that the circumferential spacing between the blade rows equal the desired size of the strip. The cylinder is also adapted for mounting at least one row of impaling pins which are generally equally spaced between the rows of blades. The blade rows function to cut a strip in the web between the preprinted areas while the impaling pins puncture and impale or hook the strip to separate and remove the strip from the web.

The size of the strip is, of course, determined by the desired size of the web insert. Previous notch cylinder units have been designed to produce only one size of insert for a particular size mailer. For an example, previous notch cylinder units have been configured for either "2-around", "4-around", or "6-around" (2, 4, or 6 pairs of blade rows respectively), blade configurations which correspond to a particular insert size. Changing to another size insert and corresponding mailer, which is a multiple of the one size notch cylinder unit, requires replacing the entire notch cylinder unit. This represents a relatively time-consuming process, and requires keeping two very expensive and different sized units on hand.

What is needed, therefore, is a notch cylinder unit which is capable of producing two different sized inserts thereby allowing the user to easily change from one size mailer to another size mailer.

SUMMARY OF THE INVENTION

The present invention provides a notch cylinder unit for forming sheets made up of webs having means for cutting, separating, and removing a strip from a web, wherein the means is adjustable to accommodate cutting, separating, and removing of either two or four strips per cylinder revolution.

The notch cylinder unit comprises a cylinder body having a longitudinally extending hole and a hollow driving shaft extending therethrough, at least two rows of removable blades extending radially outwardly from and longitudinally of said cylinder body and adapted to cut a strip in a web, and a plurality of slidable mounted impaling pins generally equally spaced between the rows of blades and adapted to puncture, hook and remove the strip. The notch cylinder unit further includes an activating means for activating or deactivating the impaling pins.

Each impaling pin is slidably mounted in a slot having a bushing for mounting an impaling pin holder with a hollow cylindrical tube adapted to mate with the bushing and extending radially through the cylinder body and driving shaft. The activating means includes a notch shaft longitudinally disposed in the hollow driving shaft having a plurality of flange cams. A slidable plunger is longitudinally disposed within the cylindrical tube and bears against the shaft portion and against a rim of one of the flange cams of the notch shaft. The slidable plunger is urged resiliently against the flange cam by a compression spring. The notch shaft is longitudinally slidable in the driving shaft and adapted to bring the flange cams into or out of contact with the plunger thereby activating or deactivating the impaling pins.

The primary object of this invention, therefore, is to provide a device to produce two or more different sized inserts; to provide a device for selectively activating a plurality of impaling pins; and to provide a device to cut, separate, and remove different size web strips.

Other objects and advantages of the invention will be apparent from the following description, the accompanying drawings and the appended claims.

DETAILED DESCRIPTION OF THE PREFERRED EMBODIMENT

Figure 6:
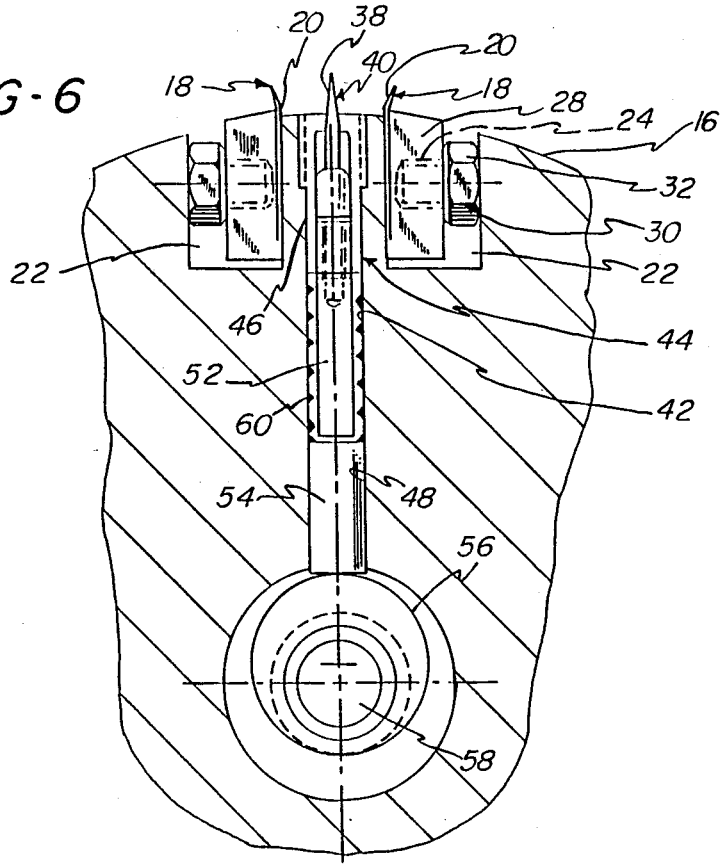
FIG. 6 is a cross-sectional view of a segment of a cylinder body having removable blades and slidably mounted impaling pins.

Machines for cutting, separating, and removing a strip 10 from a web 12 are well known. In general, as shown in FIGS. 1 through 6, a web 12 is fed between a pair of driven cylinders or rolls 14 and 16. Cylinder 16 is slotted and at least two radially outwardly, longitudinally extending, generally parallel rows 18 of removable blades 20 are inserted into the slots 22 (FIG. 6). The blade rows 18 are positioned such that the circumferential spacing $W_1$ (FIG. 5) between the blade rows 18 equal the desired width $W_2$ (FIG. 1) of the strip 10.

In a preferred embodiment of the invention, as described herein, the notch cylinder unit is adapted to allow the user to produce more than one size of insert. By removing or inserting blade rows 18 and by activating or deactivating corresponding slidable mounted impaling pin rows 40, the user can easily change from a "2-around" configuration (FIG. 2) to a "4-around" configuration (FIG. 3), or multiples thereof.

As shown in FIG. 6, each blade row 18 of cylinder 16 includes a plurality of threaded bores 24 opening through one face 26 of a side wall 28. Each bore 24 is oriented to perpendicularly intersect face 26 and is adapted to receive a set crew 30, which may be advanced or retracted along bore 24 by an appropriate tool, such as a wrench (not shown). When a blade row 18 is inserted into a slot 22, the set screw 30 disposed within the corresponding bore 24 maybe retracted until its head 32 contacts face 34 of slot 22 thereby frictionally securing the blade row 18 in slot 22.

Figure 1:
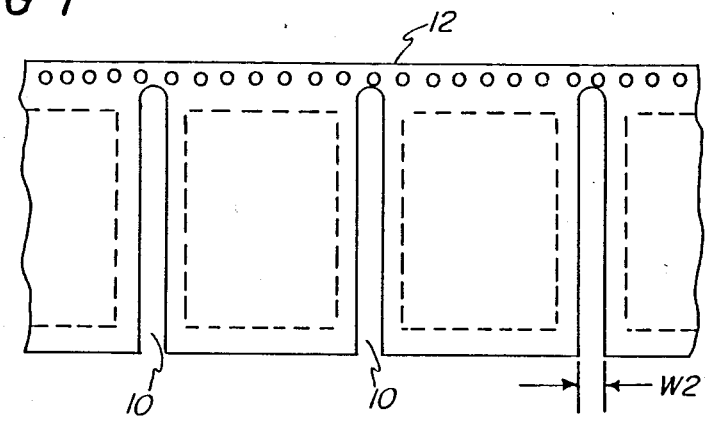
FIG. 1 is a fragmentary plan view of a web which is to be utilized to form inserts within an envelope assembly.
Figure 2:
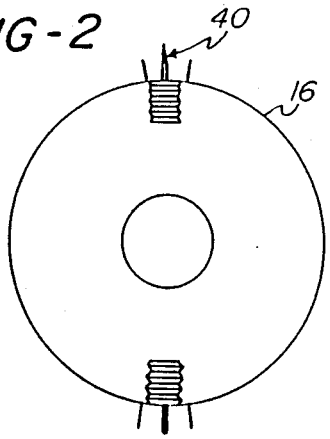
FIG. 2 is a side elevation view showing a driven cylinder having a typical 2-around blade configuration with fixed impaling pins.
Figure 3:
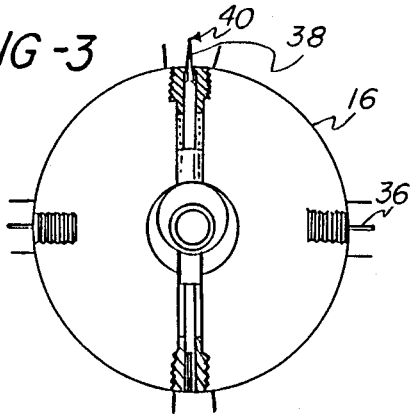
FIG. 3 is a side elevation view showing a driven cylinder having a typical 4-around blade configuration with fixed and slidably mounted impaling pins.
Figure 4:
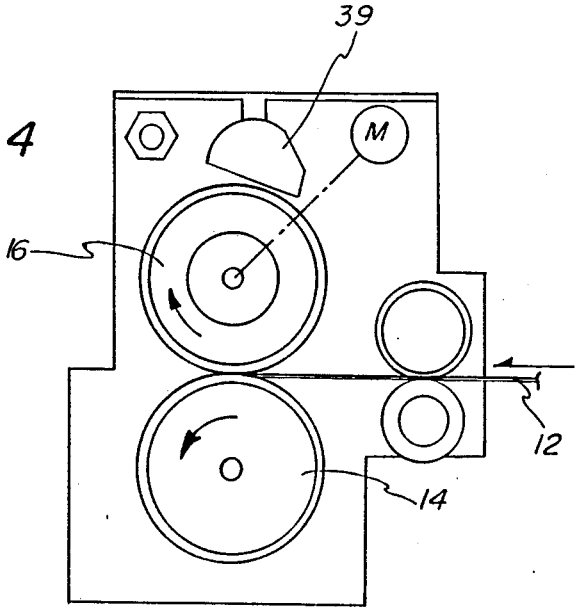
FIG. 4 is a side elevation view showing a pair of driven cylinders.
Figure 5:
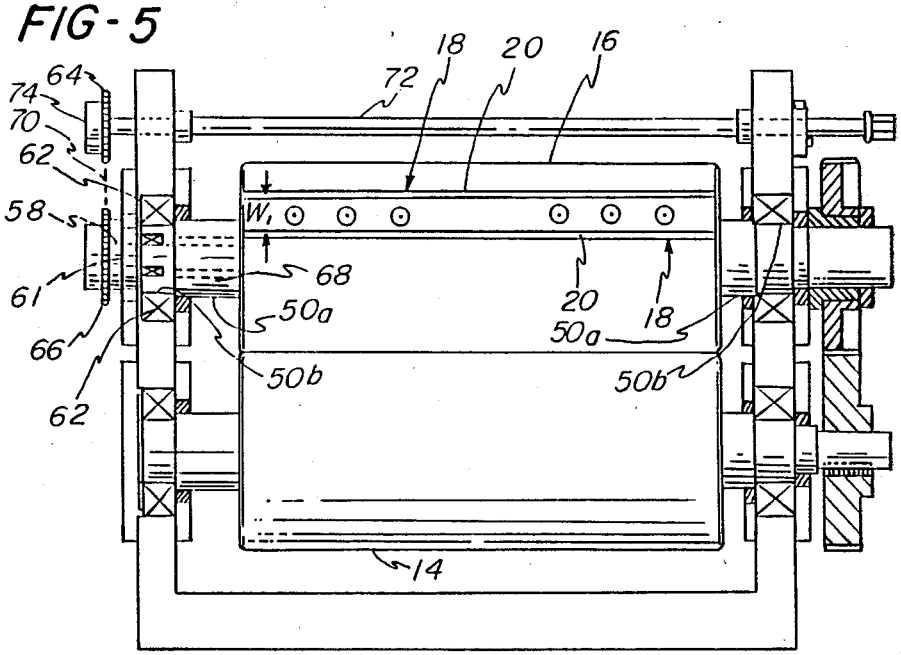
FIG. 5 is a front elevation view showing a pair of driver cylinders and the notch cylinder unit.

Located between and substantially equally spaced from blade rows 18 are alternating rows of permanently operable radially extending impaling pins 36 and slidably mounted impaling pins 38, which are adapted to puncture and hook strip 10 (FIGS. 2 and 3). As shown in FIG. 6, each slidably mounted pin 38 is positioned in a slot 42 having a bushing 44 for mounting an impaling pin holder 46. Each pin holder 46 includes a hollow cylindrical tube 48 adapted to mate with bushing 44 and to extend radially through cylinder 16 and driving shaft 50. The slidably mounted impaling pin 38 is disposed longitudinally within the cylindrical tube 48 and includes a shaft portion 52 slidably received in the cylindrical tube 48.

Cylindrical tube 48 further includes a longitudinally disposed slidable plunger 54 which bears against shaft portion 52 and against the rim of flange cam 56 of a notch shaft 58, and is urged resiliently against flange cam 56 by a compression spring 60.

A driving shaft 50 is mounted on bearings 62 and driven by a series of gears and shafts to drive and support cylinder 16. Such driving mechanism is conventional and is not shown here.

Notch shaft 58 is positioned longitudinally and concentrically within driven cylinder 16 and journaled using roller bearings 61 so not to rotate within driving shaft 50. To activate a plurality of slidably mounted impaling pins 38, the notch shaft 58 is advanced or retracted longitudinally within shaft 50 by a series of cooperating sprockets 64 and 66 until the flange cams 56 come into contact with plungers 54 and urges the shaft portion 52 of each pin holder 46 radially outwardly through cylindrical tube 48 thereby urging each slidably mounted impaling pin 38 outwardly out of slot 42.

In operation, a web 12 is fed through driven cylinders 14 and 16. As cylinder 16 rotates, the web 12 is cut transversely across its longitudinal extent while a plurality of activated pins 38 puncture and hook the strip 10 to separate and remove the strip from the web 12. Vacuum means 39 (FIG. 4) functions to remove the separated strip 10 from the activated pins 38.

In a preferred embodiment of the invention, the notch shaft 58 is coaxially mounted in a rotatable bushing 68 and to a sprocket 64 which cooperates with a sprocket 66 by a linkage means 70. Sprocket 66 is mounted to a shaft 72 which may be rotated by a knob or handle 74, such that the rotation of the knob rotates sprocket 66. As sprocket 66 rotates, the linkage means 70 rotates sprocket 64 and rotatable bushing 68 to longitudinally advance or retract the notch shaft 58.

The user can change from one insert forming configuration to another insert forming configuration by inserting or removing the blade rows 18 and by advancing or retracting the notch shaft 58 to engage or disengage contact between each flange cam 56 and each plunger 54. In this way, the user can easily change from a "2-around" notch cylinder unit configuration to a "4-around" configuration, or multiples thereof, without replacing the entire notch cylinder unit.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a notch cylinder unit for a web processing machine wherein at least one web (12) is formed into units by cutting, separating, and removing a strip (10) from the web at regular intervals, said cylinder unit including a rotatable notching cylinder (16) having a surface adapted to engage the web and having at least two notching mechanisms mounted in said surface spaced circumferentially of the surface from each other, each notching mechanism including a pair of removable spaced apart blades extending across said surface and a plurality of impaling pins reciprocably mounted for movement through said surface between said blades, and means for actuating said pins to move outward of the surface while said blades are engaged with the web to impale a strip of web material on said pins; the improvement comprising said actuating means including means for disabling the reciprocation of said pins in one of said notching mechanisms, and means to easily remove the associated pair of spaced blades, to change the number of strips removed per unit length of the web.

2. A notch cylinder unit as defined in claim 1 comprising;

said cylinder (16) having a hollow driving shaft (50) coaxially of and connected to rotate said cylinder;

said impaling pins (38) being generally equally spaced between said pair of blades and cams associated with said shaft and driving said pins to impale and remove a strip (10) severed from the web by said blades; and said disabling means acting to prevent said cams from driving said pins in said one notching mechanism.

3. A notch cylinder as defined in claim 2, including a stationary notch control shaft (58) having said cams mounted thereto in position to actuate said pins of said one notching mechanism in properly timed relation, means supporting said notch control shaft for longitudinal motion with respect to said driving shaft (50) and said cylinder (16), and means for moving said notch control shaft to displace those of said cams associated with the pins of said one notching mechanism into and out of contact with such pins thereby activating or deactivating the impaling pins of the one notching mechanism.

* * * * *